United States Patent [19]

Cantos, Jr.

[11] 4,269,104

[45] May 26, 1981

[54] HAND FLUTE AND PERCUSSION INSTRUMENT

[76] Inventor: Earl J. Cantos, Jr., 5249 Marlborough Dr., San Diego, Calif. 92116

[21] Appl. No.: 96,699

[22] Filed: Nov. 23, 1979

[51] Int. Cl.[3] ..... G10D 7/02; G10D 13/06

[52] U.S. Cl. ..... 84/330; D17/10; D17/22; 46/179; 46/191; 84/380 C

[58] Field of Search ..... D17/10, 13, 99; 46/179, 46/180; 84/330, 380 C

[56] References Cited

U.S. PATENT DOCUMENTS

| | | | |
|---|---|---|---|
| D. 245,807 | 9/1977 | Plank | D17/10 |
| 3,131,590 | 5/1964 | Lee | 84/330 |
| 3,595,121 | 7/1971 | Magers | 84/330 |

*Primary Examiner*—Lawrence R. Franklin

*Attorney, Agent, or Firm*—Henri J. A. Charmasson

[57] ABSTRACT

A musical instrument of the woodwind type in combination with a raised oblong resonance chamber, said instrument configured in the shape of a human hand. The resonance feature is utilized by placing the oblong or blister-like protrusion against the cheek of a user which, when tapped on its opposite side achieves tonal variations as a function of size variation and degree of modulations of the oral cavity. The woodwind function is achieved by blowing through a mouthpiece (the thumb digit) and egress of wind passing through the fingerhole portions of the remaining four finger digits.

6 Claims, 4 Drawing Figures

HAND FLUTE AND PERCUSSION INSTRUMENT

TECHNICAL FIELD

The invention is in the field of musical instruments and more particularly instruments of the woodwind type and further includes the feature of a resonance chamber which functions as a percussion instrument.

SUMMARY OF THE INVENTION

The present invention comprises a musical instrument for producing a variety of flutelike and tonal sounds. The first function is accomplished in the same manner as usual wind instruments, i.e., an instrument consisting of a tube with a series of fingerholes or keys in which the wind is diverted through a flue containing a sharp-edged member or reed. The present invention is configured in the shape of a human hand and wrist portion with fingerholes disposed at the terminal portions of each finger digit. The thumb is in the shape of a whistle and functions as a blow-hole which contains the reed member. Egress of wind is through the exposed fingerhole members; musical variety, of course, being accomplished by different combinations of fingerhole coverage. The hand portion is supported by a handle which is held in one hand while the other hand articulates the appropriate fingerholes while the user blows through the thumb portion containing a reed which sets the stream of air into vibration. The latter tonal sounds are accomplished by a blister-like protrusion which is integral with the chamber's hollow enclosure and can be seen protruding on the ventral or palm side of the hand. This oblong protrusion traverses the length of the palm and wrist portion and is dimensioned to snugly abut the outer cheek of the user, i.e., the mandible being slightly open, leaving a clearance between the maxilla and mandible wherein the resonance chamber is held at an oblique angle with one hand while the other hand taps the dorsal side of the hollow enclosure. Tonal variations are thus accomplished with the simultaneous tapping while the user varies the dimensions of his mouth cavity (as in articulating speech sounds) and, of course, varying the opening of the mouth itself. An interaction is thus created which produces as many tones as the user can generate in terms of the aforementioned physical phenomena.

DETAILED DESCRIPTION OF THE PREFERRED EMBODIMENTS

Figure 1:
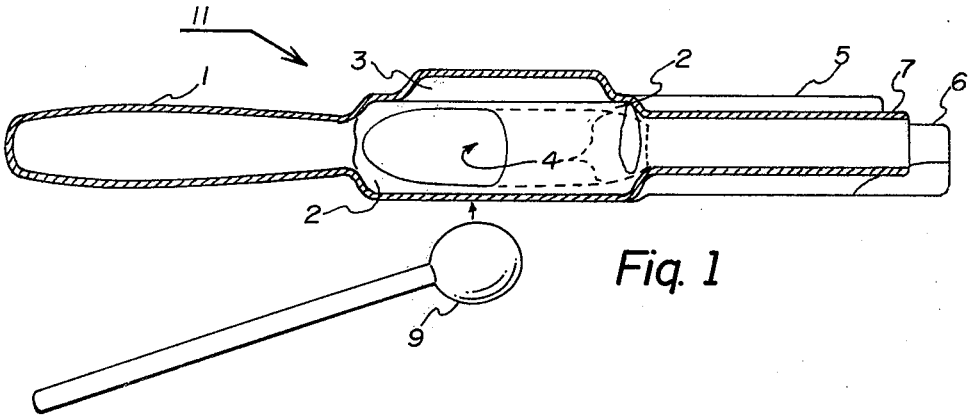
FIG. 1 is a side elevation view of the hand flute and tapper.

Referring to FIG. 1, the overall assembly is shown generaly at 11. A handle is connected to windway chamber 2 which is integral with blister-like protrusion 3. Thumb portion 4 contains the reed mechanism for ingress of wind and the other visible fingers 5, 6 and 7 contain fingerhole orifices for egress of wind. Finger 7 is shown in cutaway view to illustrate relative dimensions of the wind chamber and its manner of interconnection with windway chamber 2. A tapper 9 is also shown in perspective view in this finger which taps the dorsal side of the hand flute to accomplish tonal variations which are achieved in combination with the percussion chamber.

Figure 2:
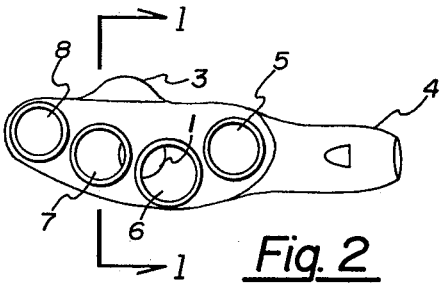
FIG. 2 is a left-hand cross sectional view showing fingerholes and flue/reed opening.

Referring now to FIG. 2, the hand flute is shown in cross section clearly delineating fingerholes 5, 6, 7 and 8 and thumb portion 4. Raised blister-like protrusion 3 can also be seen to be integral with windway chamber 2 and its relative width proportions disposed over fingerholes 7 and 5.

Figure 3:
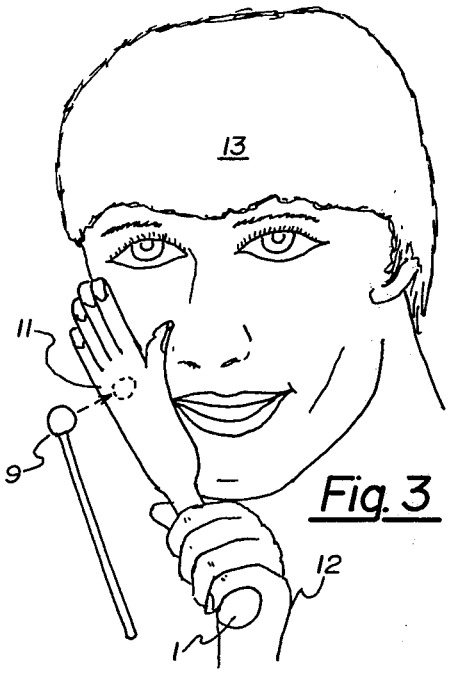
FIG. 3 is a perspective view illustrating the use of the percussion chamber feature of the hand flute by a user.

FIG. 3 illustrates the percussion feature, i.e., tapper 9 can be seen contacting the dorsal surface of hand flute 11 held by a hand 12 around handle 1. The ventral side of hand flute 11 contains the raised blister-like protrusion (not shown) which snugly abuts the jawbone of the user.

Figure 4:
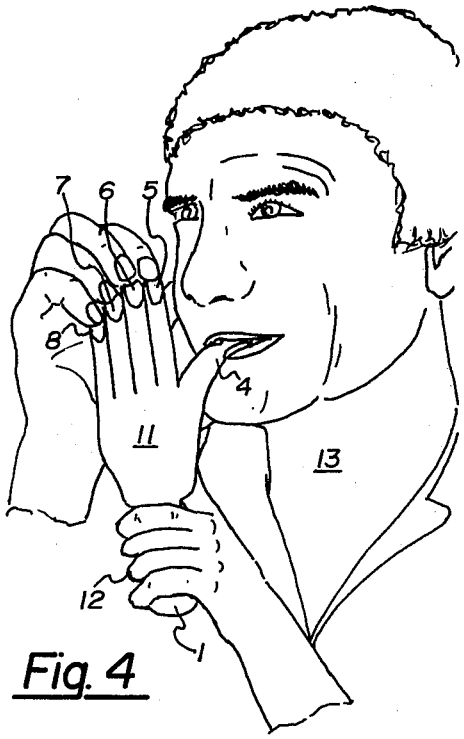
FIG. 4 is a perspective view illustrating the use of the hand flute reed and fingerhold feature (woodwind) by a user.

FIG. 4 illustrates the reed feature as shown in perspective view with user 13 holding handle 1 with hand 12 and blowing through flue/reed member 4 while simultaneously articulating fingerhole members 5, 6, 7 and 8.

It can thus be seen that this instrument embodies an extremely versatile combination of musical attributes which can be timely instituted merely by switching woodwind/percussion modes by the player.

While the preferred embodiments have been described and suggested modifications thereto, other changes could be made and other embodiments could be implemented without departing from the spirit of the invention and the scope of the appended claims.

What is claimed is:

1. A musical instrument which comprises:

an oblong, hollow enclosure having at least one opening;

one face of said enclosure having a blister-like protrusion shaped and dimensioned to rest against the jawbone of a player when said face is pressed against the player's cheek;

said hollow closure being configured in the shape of a human hand having a plurality of digits or tubular projections, at least four of said plurality of digits having openings in the terminal portions thereof to form fingerholes for egress of air flow and one of said plurality of digits having an opening in its terminal portion to form a blowhole configured in the shape of a thumb for egress of air flow.

2. The structure of claim 1 wherein said blister-like protrusion generally traverses one-half the length of said hollow enclosure longitudinally of its oblong axis and one-fourth the length of said hollow enclosure's latudinal axis.

3. The structure of claim 1 and further including a handle disposed at one end of said hollow enclosure, said handle being progressively contoured concavely from end to end.

4. The structure of claim 1 and further including an elongated member terminating in a rounded sphere for percussing said hollow enclosure on the opposite side of said blister-like protrusion.

5. A method for using the structure of claim 1 which comprises the steps of:

holding said blister-like protrusion against the cheek of a player; and striking said blister-like protrusion with a tapping device or a player's hand.

6. The method claimed in claim 5 and further including the step of the player varying the configuration and dimension of his mouth cavity while tapping said blister-like protrusion to achieve a variety of resonance and tonal variations.

* * * * *